US011081806B2

(12) United States Patent
Kim et al.

(10) Patent No.: US 11,081,806 B2
(45) Date of Patent: Aug. 3, 2021

(54) ANTENNA APPARATUS

(71) Applicant: Samsung Electro-Mechanics Co., Ltd., Suwon-si (KR)

(72) Inventors: Nam Ki Kim, Suwon-si (KR); Won Cheol Lee, Suwon-si (KR); Dae Ki Lim, Suwon-si (KR); Jeong Ki Ryoo, Suwon-si (KR); Dong Ok Ko, Suwon-si (KR); Eun Young Jung, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 16 days.

(21) Appl. No.: 16/659,952

(22) Filed: Oct. 22, 2019

(65) Prior Publication Data

US 2020/0395677 A1 Dec. 17, 2020

(30) Foreign Application Priority Data

Jun. 12, 2019 (KR) ..... 10-2019-0069535

(51) Int. Cl.

| | |
|---|---|
| ***H01Q 21/06*** | (2006.01) |
| ***H01Q 21/24*** | (2006.01) |
| ***H01Q 1/48*** | (2006.01) |
| *H01Q 1/24* | (2006.01) |

(52) U.S. Cl.

CPC ..... *H01Q 21/062* (2013.01); *H01Q 1/48* (2013.01); *H01Q 21/245* (2013.01); *H01Q 1/243* (2013.01)

(58) Field of Classification Search

CPC ..... H01Q 21/062; H01Q 21/12; H01Q 9/28; H01Q 19/28; H01Q 5/48; H01Q 1/48; H01Q 9/0414; H01Q 1/521; H01Q 21/245; H01Q 1/243; H01Q 21/28

See application file for complete search history.

(56) References Cited

U.S. PATENT DOCUMENTS 3,267,479 A * 8/1966 Smith ..... H01Q 19/30 343/806
3,371,348 A * 2/1968 Simons ..... H01Q 5/00 343/807

(Continued)

FOREIGN PATENT DOCUMENTS

KR 10-2006-0123188 A 12/2006
KR 10-1263416 B1 5/2013

(Continued)

*Primary Examiner* — Graham P Smith
*Assistant Examiner* — Jae K Kim
(74) *Attorney, Agent, or Firm* — NSIP Law

(57) ABSTRACT

An antenna apparatus includes a first feed line and a second feed line spaced apart from each other, a ground plane surrounding a portion of each of the first and second feed lines, a first end-fire antenna pattern and a second end-fire antenna pattern having different sizes spaced apart from each other, spaced apart from the ground plane, and respectively electrically connected to the first and second feed lines, and a first feed via and a second feed via respectively electrically connecting the first and second feed lines to the first and second end-fire antenna patterns. The first feed via extends away from the first feed line in one direction, and the second feed via extends away from the second feed line in another direction different from the one direction.

20 Claims, 14 Drawing Sheets

(56) References Cited

U.S. PATENT DOCUMENTS 4,315,264 A * 2/1982 DuHamel ..... H01Q 21/205 343/797
7,990,307 B1 * 8/2011 Lopez ..... H01Q 21/24 342/4
2005/0099353 A1 * 5/2005 Jones ..... H01Q 1/28 343/795
2005/0099354 A1 * 5/2005 Durham ..... H01Q 19/10 343/795
2005/0099355 A1 * 5/2005 Durham ..... H01Q 1/38 343/795
2005/0099356 A1 * 5/2005 Durham ..... H01Q 21/065 343/795
2005/0099357 A1 * 5/2005 Durham ..... H01Q 21/062 343/795
2008/0291106 A1 * 11/2008 Kai ..... H01Q 1/2225 343/797
2009/0079655 A1 * 3/2009 Kim ..... H01Q 13/10 343/846
2011/0175782 A1 * 7/2011 Choi ..... H01Q 5/42 343/798
2015/0116174 A1 * 4/2015 Yona ..... H01Q 21/26 343/797
2015/0263415 A1 * 9/2015 Moon ..... H01Q 19/104 343/702
2016/0141765 A1 * 5/2016 Moon ..... H01Q 9/285 343/812
2016/0248166 A1 * 8/2016 Moon ..... H01Q 19/10
2018/0040955 A1 * 2/2018 Vouvakis ..... H01Q 5/48
2018/0115068 A1 * 4/2018 Sazegar ..... H01Q 9/0428
2018/0309198 A1 * 10/2018 Yu ..... H01Q 13/085
2018/0309203 A1 * 10/2018 Yu ..... H01Q 1/241

FOREIGN PATENT DOCUMENTS

KR 10-2014-0034932 A 3/2014
KR 10-1394437 B1 5/2014
WO WO 2005/053092 A1 6/2005
WO WO 2013/010145 A1 1/2013

* cited by examiner

ANTENNA APPARATUS

CROSS-REFERENCE TO RELATED APPLICATIONS

This application claims the benefit under 35 USC 119(a) of Korean Patent Application No. 10-2019-0069535 filed on Jun. 12, 2019, in the Korean Intellectual Property Office, the entire disclosure of which is incorporated herein by reference for all purposes.

BACKGROUND

1. Field

This application relates to an antenna apparatus.

2. Description of Related Art

Mobile communications data traffic is increasing rapidly every year. Technological development to support a rapid increase in real-time data traffic in wireless networks is actively underway. For example, Internet of Things (IoT) based data, augmented reality (AR), virtual reality (VR), live VR/AR in combination with social networking services (SNS), autonomous navigation, and a synch view for real-time image transmission from a user's view point using a subminiature camera necessitate communications methods capable of supporting the exchange of large amounts of data, for example, 5th generation (5G) communications and millimeter wave (mmWave) communications.

Thus, millimeter wave (mmWave) communications including 5th generation (5G) communications have been actively researched, and research into the standardization and commercialization of antenna apparatuses effective for performing such millimeter wave (mmWave) communications has been actively undertaken.

Radio-frequency (RF) signals in high frequency bands of, for example, 24 GHz, 28 GHz, 36 GHz, 39 GHz, and 60 GHz, are easily absorbed in the course of transmission, resulting in signal loss. Thus, the quality of communications using such RF signals may deteriorate sharply. Antennas for communications in such high frequency bands necessitate a different technical approach than conventional antenna technology, and may necessitate special technological development, such as separate power amplifiers for providing a sufficient antenna gain, integration of an antenna and a radio-frequency integrated circuit (RFIC), and achieving a sufficient effective isotropic radiated power (EIRP),

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes a first feed line and a second feed line spaced apart from each other; a ground plane surrounding a portion of each of the first and second feed lines; a first end-fire antenna pattern and a second end-fire antenna pattern having different sizes spaced apart from each other, spaced apart from the ground plane, and respectively electrically connected to the first and second feed lines, and a first feed via and a second feed via respectively electrically connecting the first and second feed lines to the first and second end-fire antenna patterns, wherein the first feed via extends away from the first feed line in one direction, and the second feed via extends away from the second feed line in another direction different from the one direction.

The first end-fire antenna pattern may include a plurality of first dipole patterns having different sizes and at least partially overlapping each other when viewed in a direction perpendicular to respective surfaces of the plurality of first dipole patterns.

A center width of each first dipole pattern of the plurality of first dipole patterns may be greater than a width of one end of the first dipole pattern and may be greater than a width of another end of the first dipole pattern.

The second end-fire antenna pattern may include a plurality of second dipole patterns overlapping each other when viewed in a direction perpendicular to respective surfaces of the plurality of second dipole patterns.

A width of one end of each second dipole pattern of the plurality of second dipole patterns may be smaller than a width of another end of the second dipole pattern, and the one end of the second dipole pattern having the smaller width may be closer to the second feed via than the other end of the second dipole pattern.

The first end-fire antenna pattern may include a plurality of first dipole patterns at least partially overlapping each other when viewed in a direction perpendicular to surfaces of the plurality of first dipole patterns, and the second end-fire antenna pattern may include a plurality of second dipole patterns at least partially overlapping each other when viewed in a direction perpendicular to surfaces of the plurality of second dipole patterns.

Each of the plurality of first dipole patterns may be larger than each of the plurality of second dipole patterns, and a number of the plurality of first dipole patterns may be greater than a number of the plurality of second dipole patterns.

At least one of the plurality of first dipole patterns may include a slit, and at least one of the plurality of second dipole patterns may include a slit.

A width of the first feed line may be greater than a width of the second feed line.

The first feed via may be connected to a first end of the first feed line, the second feed via may be connected to a first end of the second feed line, the antenna apparatus may further include a first wiring electrically connected to a second end of the first feed line; and a second wiring electrically connected to a second end of the second feed line, the ground plane may include a first recess accommodating the second end of the first line; a second recess accommodating the second end of the second feed line; a first channel accommodating the first wiring, and a second channel accommodating the second wiring, the first feed line and the first wiring may include a first impedance transformation pattern including the second end of the first feed line accommodated in the first recess of the ground plane, and the second feed line and the second wiring may include a second impedance transformation pattern including the second end of the second feed line accommodated in the second recess of the ground plane.

A length of the first feed via may be greater than a length of the second feed via.

The first end-fire antenna may be spaced apart from the ground plane in both a first direction and a second direction perpendicular to the first direction, the antenna apparatus may further include a patch antenna pattern spaced apart from the ground plane in the second direction, and a distance between at least a portion of the first end-fire antenna pattern and the ground plane in the second direction may be equal to or greater than a distance between the patch antenna pattern and the ground plane in the second direction.

The first end-fire antenna pattern may be spaced further away from the ground plane than the second end-fire antenna pattern.

The antenna apparatus may further include a blocking pattern disposed between the first and second feed lines and spaced apart from the ground plane.

The blocking pattern may be a loop spaced apart from the ground plane, extending away from the ground plane, and having a gap in a side of the loop closest to the ground plane.

The blocking pattern may be disposed between a portion of each of the first and second end-fire antenna patterns and the ground plane.

In another general aspect, an antenna apparatus includes a ground plane extending in a first direction and a second direction perpendicular to the first direction; a first end-fire antenna pattern spaced apart from an edge of the ground plane in the first direction; a second end-fire antenna pattern spaced apart from the edge of the ground plane in the first direction and spaced apart from the first end-fire antenna pattern in the second direction; a first feed via including a first end and a second end, the first end of the first feed via being electrically connected to the first end-fire antenna pattern; a second feed via including a first end and a second end, the first end of the second feed via being electrically connected to the second end-fire antenna pattern; a first feed line including a first end and a second end, the first end of the first feed line being electrically connected to the second end of the first feed via; and a second feed line including a first end and a second end, the first end of the second feed line being electrically connected to the second end of the second feed via, wherein the first feed via extends away from the first feed line in a third direction perpendicular to the first direction, the second feed via extends away from the second feed line in a direction opposite to the third direction, and the ground plane includes a first recess in the edge of the ground plane, the first recess accommodating the second end of the first feed line; and a second recess in the edge of the ground plane, the second recess accommodating the second end of the second feed line.

The antenna apparatus may further include a first wiring including a first end connected to the second end of the first feed line; a second wiring including a first end connected to the second end of the second feed line, and the ground plane may further include a first channel accommodating the first wiring; and a second channel accommodating the second wiring.

The first end-fire antenna pattern may include a plurality of first dipole patterns, the second end-fire antenna pattern may include a plurality of second dipole patterns, the first end of the first feed via may be connected to a first one of the first dipole patterns, and remaining ones of the first dipole patterns are sequentially spaced apart from the first one of the first dipole patterns in the third direction, and the first end of the second feed via may be connected to a first one of the second dipole patterns, and remaining ones of the second dipole patterns are sequentially spaced apart from the first one of the second dipole patterns in the direction opposite to the third direction.

The antenna apparatus may further include a patch antenna pattern spaced apart from the ground plane in the third direction, and a distance from the ground plane to a last one of the first dipole patterns farthest away from the ground plane may be equal to or greater than a distance from the ground plane to the patch antenna pattern.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
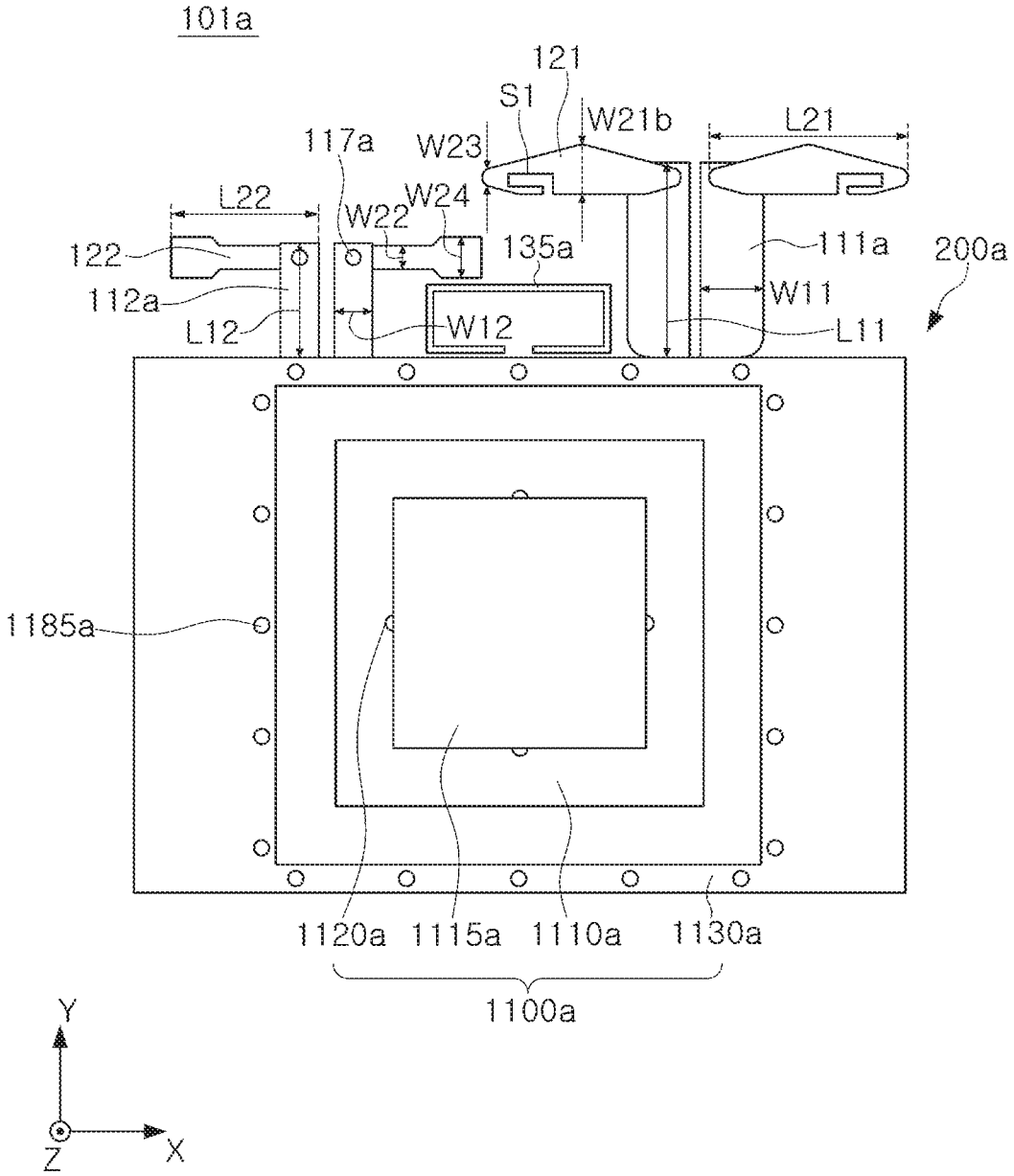
FIGS. 1A, 1B, and 1C are respectively top, bottom, and left-side views illustrating an example of an antenna apparatus.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated by 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Figure 1B:
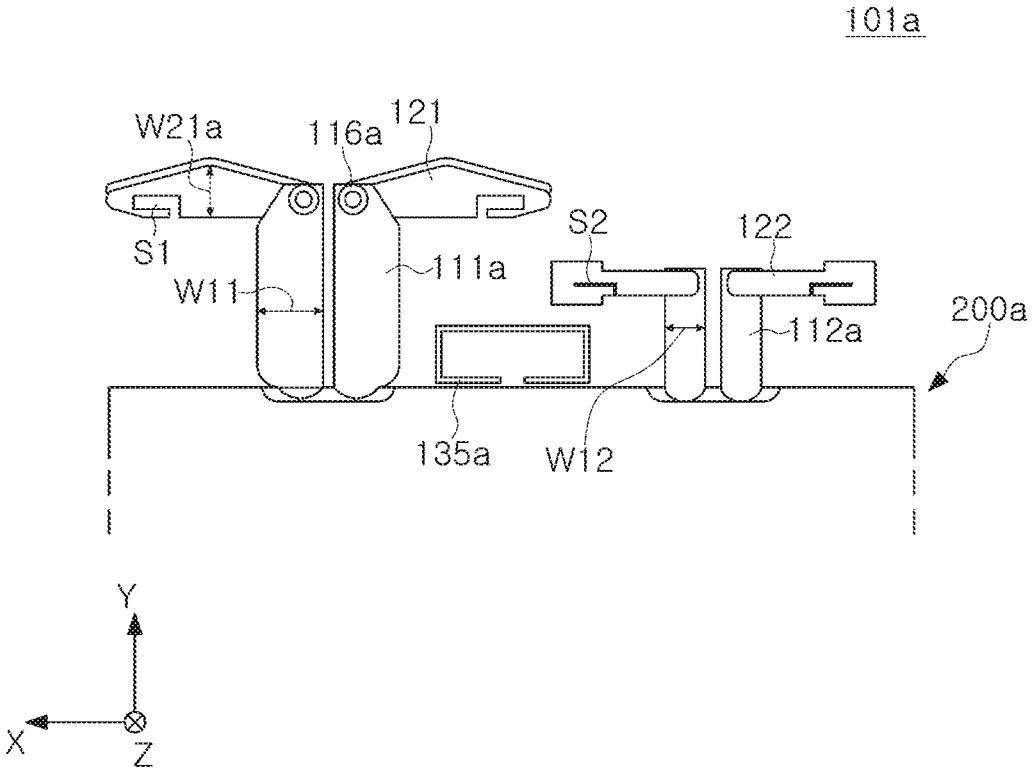
Figure 1C:
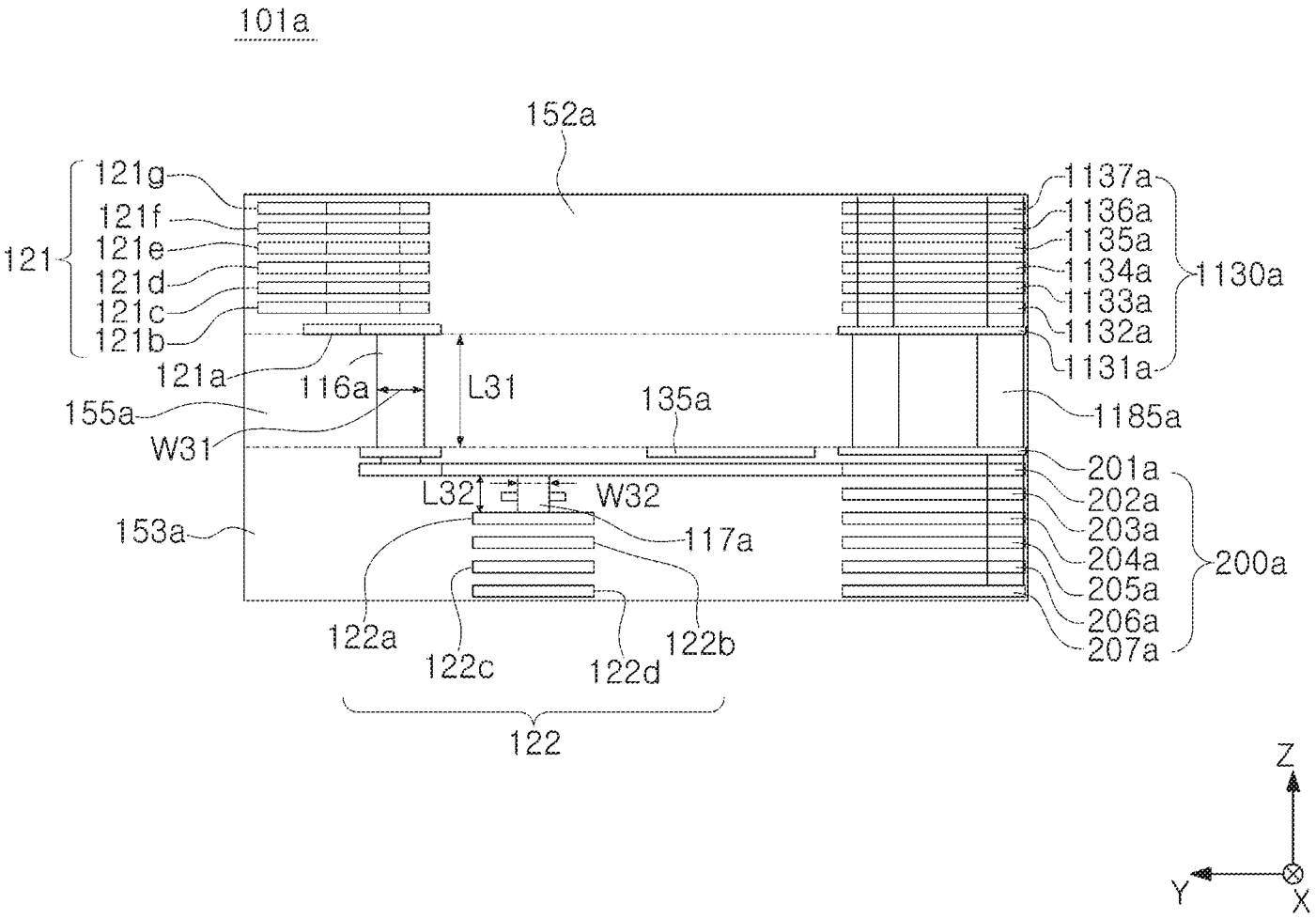

FIGS. 1A, 1B, and 1C are respectively top, bottom, and left-side views illustrating an example of an antenna apparatus.

Referring to FIGS. 1A, 1B, and 1C, an antenna apparatus 101*a* includes a first end-fire antenna pattern 121 and a second end-fire antenna pattern 122 to provide a transmission and reception unit for a plurality of different frequency bands.

The first end-fire antenna pattern 121 is electrically connected to a first feed via 116*a*, and the first feed via 116*a* is electrically connected to a first feed line 111*a*.

The second end-fire antenna pattern 122 is electrically connected to a second feed via 117*a*, and the second feed via 117*a* is electrically connected to a second feed line 112*a*.

The first and second end-fire antenna patterns 121 and 122 receive first and second radio-frequency (RF) signals transmitted through the first and second feed lines 111*a* and 112*a*, respectively, and the first and second feed vias 116*a* and 117*a*, respectively, to transmit the RF signals in a direction away from the antenna apparatus 101*a*, for example, in the Y direction, and receive RF signals propagating in a direction toward the antenna apparatus 101*a*, for example, in the −Y direction. The first RF signal has a first frequency (for example, 28 GHz), and the second RF signal has a second frequency (for example, 39 GHz).

The first and second feed lines 111*a* and 112*a* are respectively electrically connected to first and second wiring vias (not shown) in a connection member 200*a*, and the first and second wiring vias are electrically connected to an integrated circuit (IC) (not shown) disposed on a bottom surface of the connection member 200*a*, for example, in a −Z direction. The IC performs operations such as amplification, filtering, frequency conversion, and phase control for the first and second RF signals, and transmits and receives the first and second RF signals to and from the first and second end-fire antenna patterns 121 and 122. The IC may also be configured as a plurality of ICs depending on the design.

The first and second feed lines 111*a* and 112*a* are electrically isolated from each other. Accordingly, the first and second end-fire antenna patterns 121 and 122 have independent radiation patterns.

The first and second feed lines 111*a* and 112*a* may respectively include a plurality of first feed lines and a plurality of second feed lines. For example, the plurality of first feed lines and the plurality of second feed lines may be differential feed lines, but are not limited thereto. For example, one of the plurality of first feed lines and one of the plurality of second feed lines may be electrically connected to a ground plane of the connection member 200*a*.

The first and second end-fire antenna patterns 121 and 122 respectively resonate in first and second frequency bands to strongly receive energy corresponding to the first and second RF signals during reception, and strongly radiate energy corresponding to the first and second RF signals externally during transmission.

The connection member 200*a* reflects first and second RF signals radiated toward the connection member 200*a* by the first and second end-fire antenna patterns 121 and 122 to concentrate radiation patterns of the first and second end-fire antenna patterns 121 and 122 in the direction away from the antenna apparatus 101*a* (for example, in the Y direction). Accordingly, gains of the first and second end-fire antenna patterns 121 and 122 are improved.

The first and second end-fire antenna patterns 121 and 122 resonate at respective resonant frequencies that depend on a combination of an inductance and a capacitance of peripheral structures of the first and second end-fire antenna patterns 121 and 122.

Each of the first and second end-fire antenna patterns 121 and 122 has a bandwidth that depends on an intrinsic resonant frequency of the end-fire antenna pattern that is determined by intrinsic parameters of the end-fire antenna pattern (for example, a shape, a size, a thickness, a spacing distance, and a dielectric constant of an insulating layer). The bandwidth also depends on extrinsic factors affecting the intrinsic resonant frequency, such as electromagnetic couplings with an adjacent pattern and an adjacent via.

A length L22 of the second end-fire antenna pattern 122 is shorter than a length L21 of the first end-fire antenna pattern 121, and therefore the second end-fire antenna pattern 122 has an inductance and a capacitance that are smaller than an inductance and a capacitance of the first end-fire antenna pattern 121. Thus, resonance with respect to the second RF signal having a shorter wavelength and higher a frequency among the first and second RF signals is relatively dominant in the second end-fire antenna pattern 122.

The first RF signal transmitted and received by the first end-fire antenna pattern 121 causes electromagnetic interference with the second end-fire antenna pattern 122, and the second RF signal transmitted and received by the second end-fire antenna pattern 122 causes electromagnetic interference with the first end-fire antenna pattern 121. Such electromagnetic interference reduces the gains of the first and second RF signals.

As can be seen from FIG. 1C, the first and second feed vias 116*a* and 117*a* respectively extend in different directions away from the first and second feed lines 111*a* and 112*a*, thereby reducing the electromagnetic interference between the first and second end-fire antenna patterns 121 and 122, and improving the gains of the first and second RF signals.

The first RF signal transmitted through the first feed line 111*a* has a +Z direction vector component after it enters the first feed via 116*a*, and the second RF signal transmitted through the second feed line 112*a* has a −Z direction vector component after it enters the second feed via 117*a*.

Accordingly, a radiation pattern of the first end-fire antenna pattern 121 is slightly inclined in the +Z direction, and a radiation pattern of the second end-fire antenna pattern 122 is slightly inclined in the −Z direction.

This increases the distance between the radiation patterns of the first and second end-fire antenna patterns 121 and 122. Accordingly, electromagnetic interference between the first and second end-fire antenna patterns 121 and 122 is reduced, and the gains of the first and second RF signals are increased.

Further, as a result of the structure in which the first and second feed vias 116*a* and 117*a* respectively extend in different directions away from the first and second feed lines 111*a* and 112*a*, a height difference between the first and second end-fire antenna patterns 121 and 122, that is, a distance between the first and second end-fire antenna patterns 121 and 122 in the Z direction, is further increased.

In other words, radiation pattern formation start points of the first and second end-fire antenna patterns 121 and 122 are further apart from each other. Accordingly, the radiation patterns of the first and second end-fire antenna patterns 121 and 122 are formed further away from each other. Accordingly, electromagnetic interference between the first and second end-fire antenna patterns 121 and 122 is reduced, and the gains of the first and second RF signals are increased.

The first end-fire antenna pattern 121 includes a plurality of first dipole patterns 121*a*, 121*b*, 121*c*, 121*d*, 121*e*, 121*f*, and 121*g*, and the second end-fire antenna pattern 122 includes a plurality of second dipole patterns 122*a*, 122*b*, 122*c*, and 122*d*.

The plurality of first dipole patterns 121*a*, 121*b*, 121*c*, 121*d*, 121*e*, 121*f*, and 121*g* overlap each other when viewed in the Z direction, and the plurality of second dipole patterns 122*a*, 122*b*, 122*c*, and 122*d* overlap each other when viewed in the Z direction.

The plurality of first dipole patterns 121*a*, 121*b*, 121*c*, 121*d*, 121*e*, 121*f*, and 121*g* are electromagnetically coupled to each other in the +Z direction, and the plurality of second dipole patterns 122*a*, 122*b*, 122*c*, and 122*d* are electromagnetically coupled to each other in the −Z direction.

Accordingly, the +Z direction vector component of the first RF signal transmitted and received by the first end-fire antenna pattern 121 is further increased, and the −Z direction component of the second RF signal transmitted and received by the second end-fire antenna pattern 122 is further increased.

The plurality of first dipole patterns 121*a*, 121*b*, 121*c*, 121*d*, 121*e*, 121*f*, and 121*g* provide an electromagnetic surface in the Y direction, and the plurality of second dipole patterns 122*a*, 122*b*, 122*c*, and 122*d* provide an electromagnetic surface in the Y direction. The electromagnetic surfaces are surfaces in which surface currents respectively corresponding to the first and second RF signals flow, and thus serve as paths through which the first and second RF signals respectively propagate through the air. The gains of the first and second end-fire antenna patterns 121 and 122 are further improved as the widths of the electromagnetic surfaces increase.

An electromagnetic coupling between the plurality of first dipole patterns 121*a*, 121*b*, 121*c*, 121*d*, 121*e*, 121*f*, and 121*g* and an electromagnetic coupling between the plurality of second dipole patterns 122*a*, 122*b*, 122*c*, and 122*d* are extrinsic factors that affect the intrinsic resonant frequencies of the first and second end-fire antenna patterns 121 and 122, thereby causing bandwidths of the first and second end-fire antenna patterns 121 and 122 to be widened.

At least one of the plurality of first dipole patterns 121*a*, 121*b*, 121*c*, 121*d*, 121*e*, 121*f*, and 121*g* has a size different from the size of the remaining first dipole patterns, thereby causing the bandwidth of the first end-fire antenna pattern 121 to be further widened. In the example illustrated in FIGS. 1A to 1C, the first dipole pattern 121*a* is smaller than the first dipole patterns 121*b*, 121*c*, 121*d*, 121*e*, 121*f*, and 121*g* as can be seen from FIG. 1C.

A width W21*a*, W21*b* of a central portion of the first end-fire antenna pattern 121 is greater than a width W23 of each of two end portions of the first end-fire antenna pattern 121. thereof. As a result, a ratio of a Y-direction vector component in the surface current flowing in the first end-fire antenna pattern 121 is further increased, and thus a radiation pattern of the first end-fire antenna pattern 121 is further concentrated in the Y direction. In the example illustrated in FIGS. 1A and 1B, the two end portions of the first end-fire antenna pattern 121 are curved, and the width W23 is measured at the point where the first end-fire antenna pattern 121 starts to curve.

Since the first end-fire antenna pattern 121 extends farther away from the connection member 200*a* than the second end-fire antenna pattern 122, when the width W21*a*, W21*b* of the central portion of the first end-fire antenna pattern 121 is greater than the width W23 of each of the two end portions of the first end-fire antenna pattern 121, electromagnetic interference with the second end-fire antenna pattern 122 caused by the first RF signal of the first end-fire antenna pattern 121 is further reduced.

A width W22 of one end of the second end-fire antenna pattern 122 is smaller than a width W24 of the other end of the second end-fire antenna pattern 122. Accordingly, since a direction in which the second end-fire antenna pattern 122 extends away from the second feed line 117*a* s different from a direction in which the first end-fire antenna pattern 121 extends away from the first feed line 111*a*, electromagnetic interference with the first end-fire antenna pattern 121 caused by the second RF signal of the second end-fire antenna pattern 122 is further reduced.

When the width W24 of the other end of the second end-fire antenna pattern 122 is relatively wide, the second end-fire antenna pattern 122 is electromagnetically coupled more closely to a blocking pattern 135*a*. Accordingly, the blocking pattern 135*a* more effectively electromagnetically isolates the first and second end-fire antenna patterns 121 and 122 from each other.

A number of the first dipole patterns 121*a*, 121*b*, 121*c*, 121*d*, 121*e*, 121*f*, and 121*g* and a number of the second dipole patterns 122*a*, 122*b*, 122*c*, and 122*d* are not limited to any particular numbers.

In the example illustrated in FIGS. 1A to 1C, the number (seven) of the first dipole patterns 121*a*, 121*b*, 121*c*, 121*d*, 121*e*, 121*f*, and 121*g* is greater than the number (four) of the second dipole patterns 122*a*, 122*b*, 122*c*, and 122*d*.

The number of the first dipole patterns 121*a*, 121*b*, 121*c*, 121*d*, 121*e*, 121*f*, and 121*g* determines a height in the Z direction of the first end-fire antenna pattern 121, and the number of the plurality of second dipole patterns 122*a*, 122*b*, 122*c*, and 122*d* determines a height in the Z direction of the second end-fire antenna pattern 122.

The heights in the Z direction of the first and second end-fire antenna patterns 121 and 122 are intrinsic parameters that respectively play a part in determining the respective intrinsic resonant frequencies of the first and second end-fire antenna patterns 121 and 122.

Since the first end-fire antenna pattern 121 has a resonant frequency lower than a resonant frequency of the second end-fire antenna pattern 122, when the height in the Z direction of the first end-fire antenna pattern 121 is greater than the height in the Z direction of the second end-fire antenna pattern 122, the first and second end-fire antenna patterns 121 and 122 more efficiently respectively expand the first and second bandwidths corresponding to the first and second frequency bands.

A first width W11 of the first feed line 111*a* is greater than a second width W12 of the second feed line 112*a*. The first and second widths W11 and W12 of the first and second feed lines are intrinsic parameters that respectively play a part in determining the respective intrinsic resonant frequencies of the first and second end-fire antenna patterns 121 and 122.

A length L11 of the first feed line 111*a* is greater than a length L12 of the second feed line 112*a*. The lengths L11 and L12 of the first and second feed lines 111*a* and 112*a* are intrinsic parameters that respectively play a part in determining the respective intrinsic resonant frequencies of the first and second end-fire antenna patterns 121 and 122.

A length L31 of the first feed via 116*a* is greater than a length L32 of the second feed via 117*a*. The lengths L31 and L32 of the first and second feed vias 116*a* and 117*a* are intrinsic parameters that respectively play a part in determining the respective intrinsic resonant frequencies of the first and second end-fire antenna patterns 121 and 122.

A width W31 of the first feed via 116*a* is greater than a width W32 of the second feed via 117*a*. The widths W31 and W32 of the first and second feed vias 116*a* and 117*a* are intrinsic parameters that respectively play a part in determining the respective intrinsic resonant frequencies of the first and second end-fire antenna patterns 121 and 122.

As described above, as the number of intrinsic parameters that play a part in determining the respective intrinsic resonant frequencies of the first and second end-fire antenna patterns 121 and 122 increases, the first and second end-fire antenna patterns 121 and 122 more efficiently respectively expand the first and second bandwidths respectively corresponding to the first and second frequency bands.

The first and second end-fire antenna patterns 121 and 122 have respective slits S1 and S2. At least one of the plurality of first dipole patterns 121*a*, 121*b*, 121*c*, 121*d*, 121*e*, 121*f*, and 121*g* of the first end-fire antenna pattern 121 has the slit S1, and at least one of the plurality of second dipole patterns 122*a*, 122*b*, 122*c*, and 122*d* of the second end-fire antenna pattern 122 includes has the slit S2. Since the surface currents in the end-fire antenna patterns 121 and 122 having the slits S1 and S2 bypass the slits S1 and S2, electrical lengths of the end-fire antenna patterns 121 and 122 are greater than physical lengths thereof. Therefore, the end-fire antenna patterns 121 and 122 having the slits S1 and S2 can be reduced in size while maintaining the same resonant frequencies, thereby enabling the first and second end-fire antenna patterns 121 and 122 to be further spaced apart from each other. Accordingly, electromagnetic interference between the first and second RF signals is further reduced.

The blocking pattern 135*a* is disposed between the first and second feed lines 111*a* and 112*a* and is spaced apart from the connection member 200*a* in the Y direction. Accordingly, electromagnetic interference between the first and second feed lines 111*a* and 112*a* is reduced.

The blocking pattern 135*a* is a rectangular loop spaced apart from the connection member 200*a* in the Y direction, extending away from the connection member 200*a* in the Y direction, and having a gap in a side of the rectangular loop closest to the connection member 200*a*. Accordingly, the blocking pattern 135*a* forms a path through which electromagnetic energy flowing from the first and second end-fire antenna patterns 121 and 122 circulates and escapes into a ground plane of the connection member 200*a* through the gap of the blocking pattern 135*a*. Accordingly, electromagnetic interference between the first and second end-fire antenna patterns 121 and 122 is more efficiently reduced. Although the blocking pattern 135*a* in FIGS. 1A and 1B is a rectangular loop, this is just an example, and the blocking pattern 135*a* may have any shape as long as it is a loop with a gap in a side of the loop closest to the connection member 200*a*.

The blocking pattern 135*a* is disposed between portions of the first and second end-fire antenna patterns 121 and 122 and the connection member 200*a*. This enables the blocking pattern 135*a* to be more easily electromagnetically coupled to the first and second end-fire antenna patterns 121 and 122, thereby reducing electromagnetic interference between the first and second end-fire antenna patterns 121 and 122 more effectively.

The antenna apparatus 101*a* further includes a patch antenna 1100*a*.

The patch antenna 1100*a* includes a patch antenna pattern 1110*a*, an upper coupling pattern 1115*a*, a plurality of third feed vias 1120*a*, a coupling structure 1130*a*, and a plurality of peripheral vias 1185*a*, and forms a radiation pattern in the Z direction.

The coupling structure 1130*a* includes a plurality of coupling structure patterns 1131*a*, 1132*a*, 1133*a*, 1134*a*, 1135*a*, 1136*a*, and 1137*a*.

The plurality of peripheral vias 1185*a* electrically connect the coupling structure 1130*a* to the connection member 200*a*.

The patch antenna pattern 1110*a* and the upper coupling pattern 1115*a* are respectively disposed on the same levels as two of the plurality of coupling structure patterns 1131*a*, 1132*a*, 1133*a*, 1134*a*, 1135*a*, 1136*a*, and 1137*a*. The patch antenna pattern 1110*a* is disposed at a position that is higher in the Z direction than positions of a plurality of ground planes 201*a*, 202*a*, 203*a*, 204*a*, 205*a*, 206*a*, and 207*a* of the connection member 200*a*.

At least a portion of the first end-fire antenna pattern 121 is disposed on the same level as or higher than a position of the patch antenna pattern 1110*a*.

Therefore, although the antenna apparatus 101*a* includes the first and second feed vias 116*a* and 117*a* extending in different directions away from the first and second feed lines 111*a* and 112*a*, and the patch antenna pattern 1100*a* providing a radiation pattern in the Z direction, the height of the antenna apparatus 101*a* in the Z direction is not substantially increased.

The antenna apparatus 101*a* further includes a dielectric layer 152*a* disposed at a height corresponding to a height of the first end-fire antenna pattern 121, an insulating layer 153*a* disposed at a height corresponding to a height of the second end-fire antenna pattern 122, and a core layer 155*a* disposed between the dielectric layer 152*a* and the insulating layer 153*a*. However, this is just one example, and the antenna apparatus 101*a* is not limited to this particular structure.

The connection member 200*a* has a structure in which the plurality of ground planes 201*a*, 202*a*, 203*a*, 204*a*, 205*a*, 206*a*, and 207*a* are stacked. A number of the plurality of ground planes 201*a*, 202*a*, 203*a*, 204*a*, 205*a*, 206*a*, and 207*a* is not limited to any particular number.

At least one of the plurality of ground planes 201*a*, 202*a*, 203*a*, 204*a*, 205*a*, 206*a*, and 207*a* surrounds a portion of each of the first and second feed lines 111*a* and 112*a* and spaced apart from the first and second end-fire antenna patterns 121 and 122 in the −Y direction.

Figure 2A:
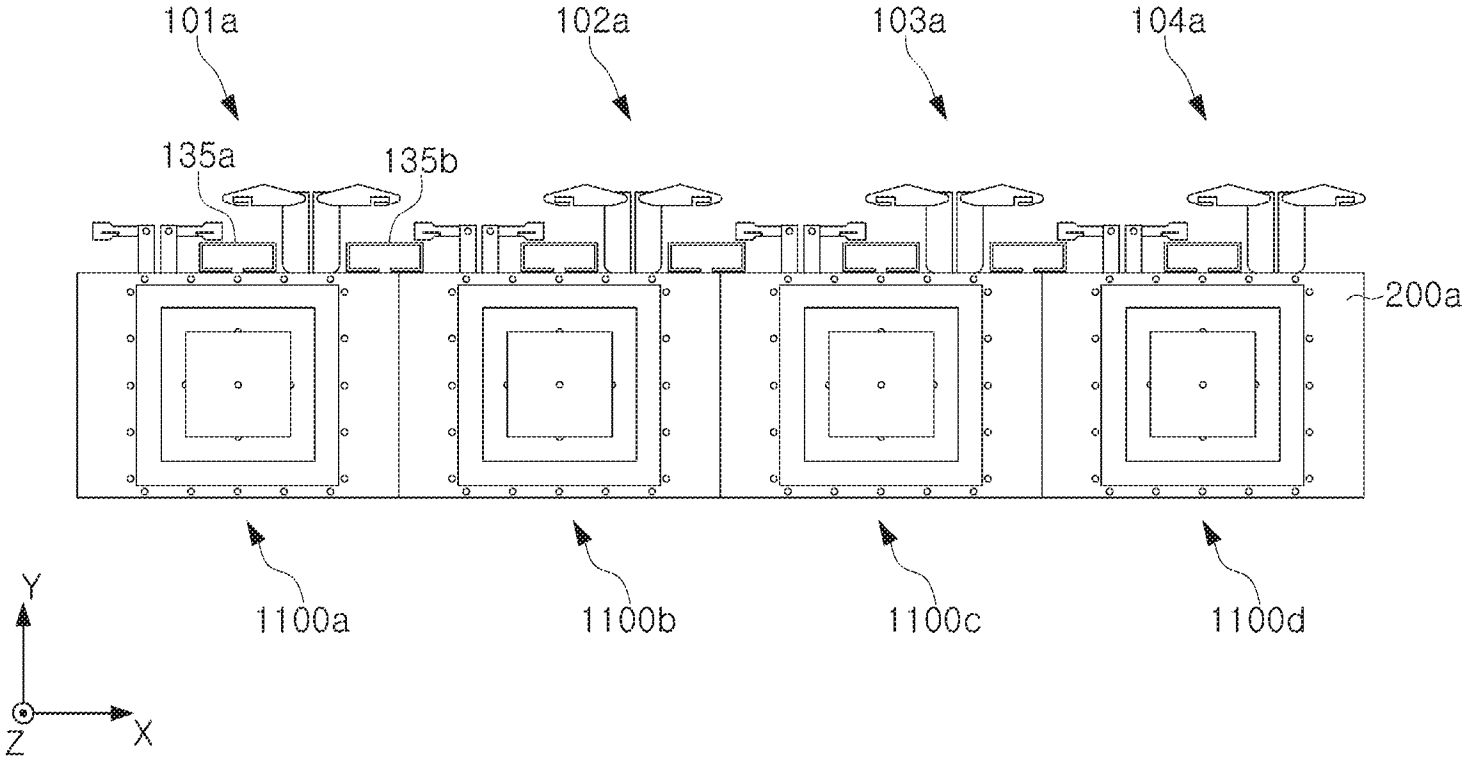
FIGS. 2A and 2B are respectively top and bottom views illustrating an example of an arrangement of a plurality of antenna apparatuses.
Figure 2B:
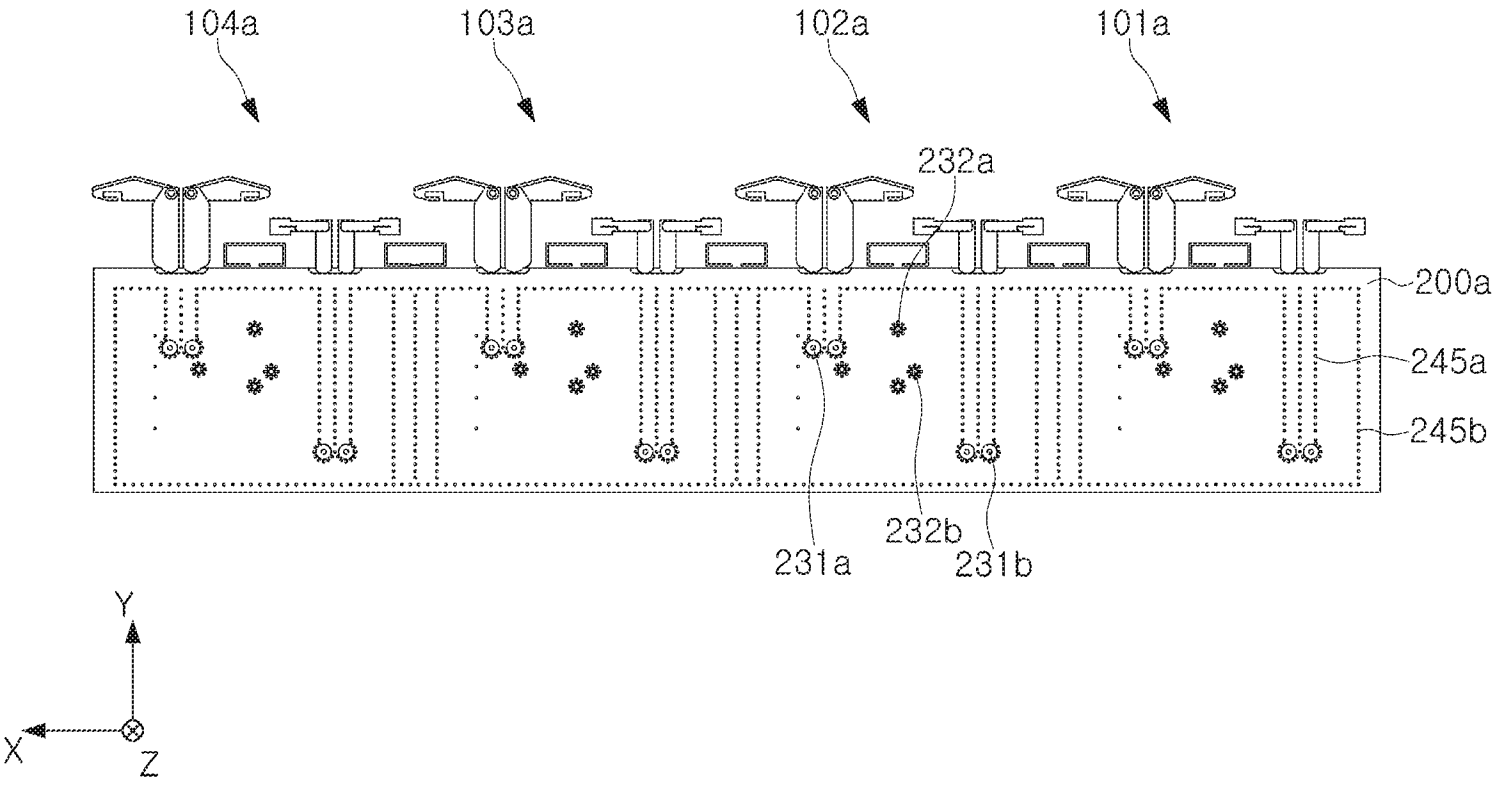
Figure 4:
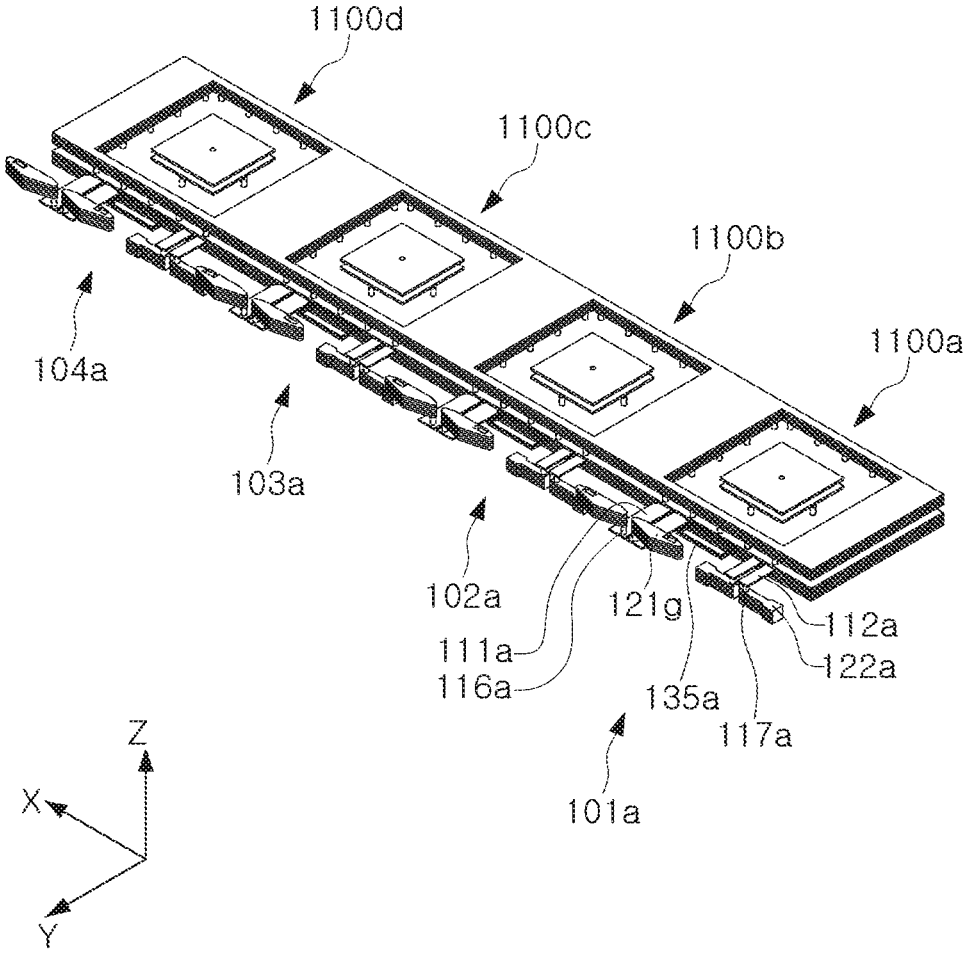
FIG. 4 is a perspective view illustrating the example of an arrangement of antenna apparatuses of FIGS. 2A and 2B.

FIGS. 2A and 2B are respectively top and bottom views illustrating an example of an arrangement of antenna apparatuses, and FIG. 4 is a perspective view illustrating the example of an arrangement of antenna apparatuses of FIGS. 2A and 2B.

Referring to FIGS. 2A, 2B, and 4, antenna apparatuses 101*a*, 102*a*, 103*a*, and 104*a* are arranged in the X direction, and concentrate radiation patterns in the Y direction.

A plurality of patch antennas 1100*a*, 1100*b*, 1100*c*, and 1100*d* are arrayed in the X direction and are disposed above the connection member 200*a* in the Z direction, and concentrate radiation patterns in the Z direction.

The antenna apparatuses 101*a*, 102*a*, 103*a*, and 104*a* are electrically connected to a plurality of first and second wiring vias 231*a* and 231*b*, and the plurality of patch antennas 1100*a*, 1100*b*, 1100*c*, and 1100*d* are electrically connected to a plurality of third and fourth wiring vias 232*a* and 232*b*.

The plurality of first, second, third, and fourth wiring vias 231*a*, 231*b*, 232*a*, and 232*b* are electrically connected to one or more ICs (not shown) disposed on a bottom surface of the connection member 200*a*.

A plurality of shielding vias 245*a* and 245*b* surround a plurality of feed lines (not shown) of the antenna apparatuses 101*a*, 102*a*, 103*a*, and 104*a* in the connection member 200*a* that are connected to the plurality of first and second wiring vias 231*a* and 231*b*.

Figure 2C:
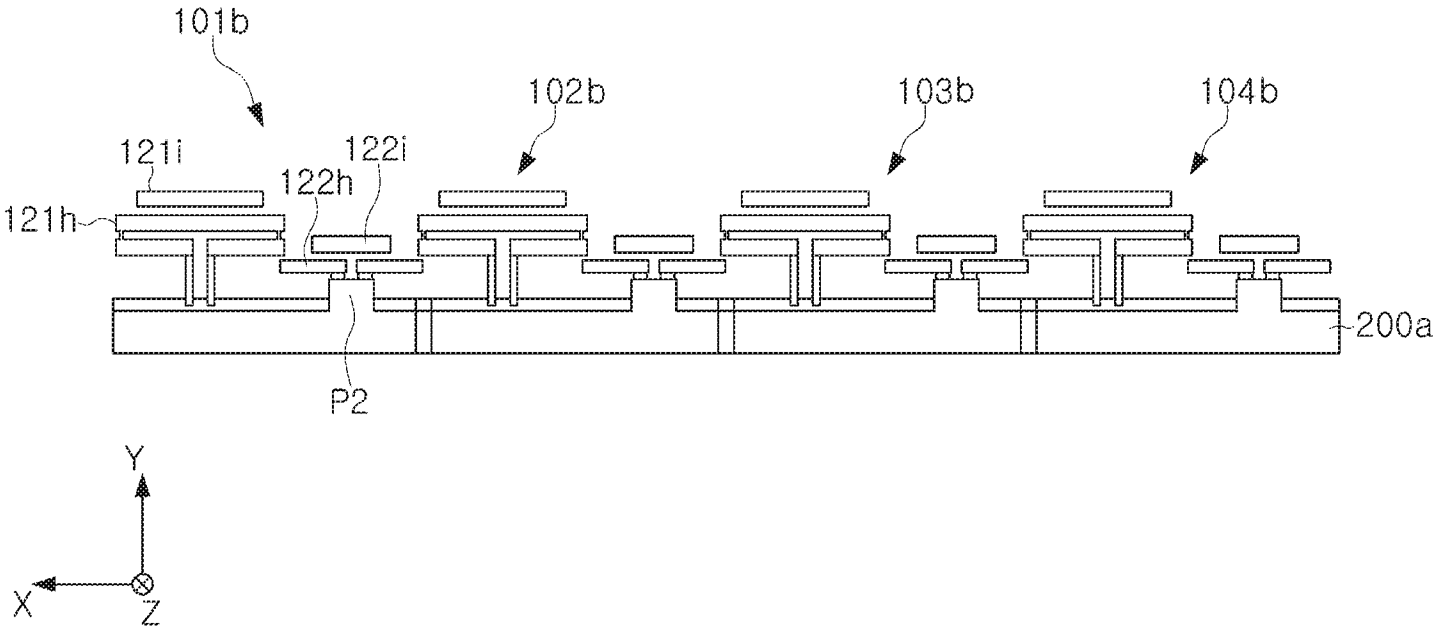
FIG. 2C is a bottom view illustrating an example of end-fire antenna patterns of antenna apparatuses.

FIG. 2C is a bottom view illustrating an example of end-fire antenna patterns of antenna apparatuses.

Referring to FIG. 2C, antenna apparatuses 101*b*, 102*b*, 103*b*, and 104*b* include first end-fire antenna patterns 121*h* and 121*i* each having a constant width, and second end-fire antenna patterns 122*h* and 122*i* each having a constant width. The connection member 200*a* includes protruding portions P2 protruding toward the second end-fire antenna patterns 122*h* and 122*i*.

Figure 2D:
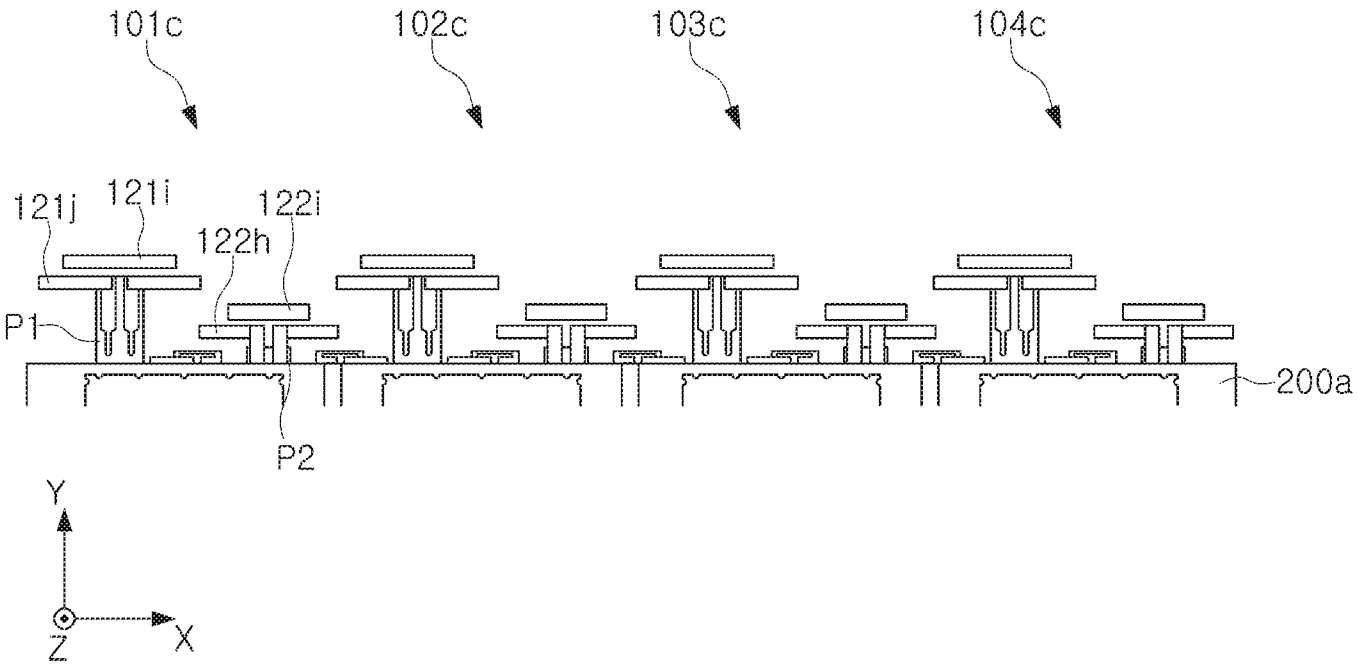
FIG. 2D is a top view illustrating another example of end-fire antenna patterns of antenna apparatuses.

FIG. 2D is a top view illustrating another example of end-fire antenna patterns of antenna apparatuses.

Referring to FIG. 2D, antenna apparatuses 101*c*, 102*c*, 103*c*, and 104*c* include first end-fire antenna patterns 121*i* and 121*j* each having a constant width, and second end-fire antenna patterns 122*h* and 122*i* each having a constant width. The connection member 200*a* includes protruding portions P1 protruding toward the first end-fire antenna patterns 121*i* and 121*j*, and protruding portions P2 protruding toward the second end-fire antenna patterns 122*h* and 122*i*.

Figure 3:
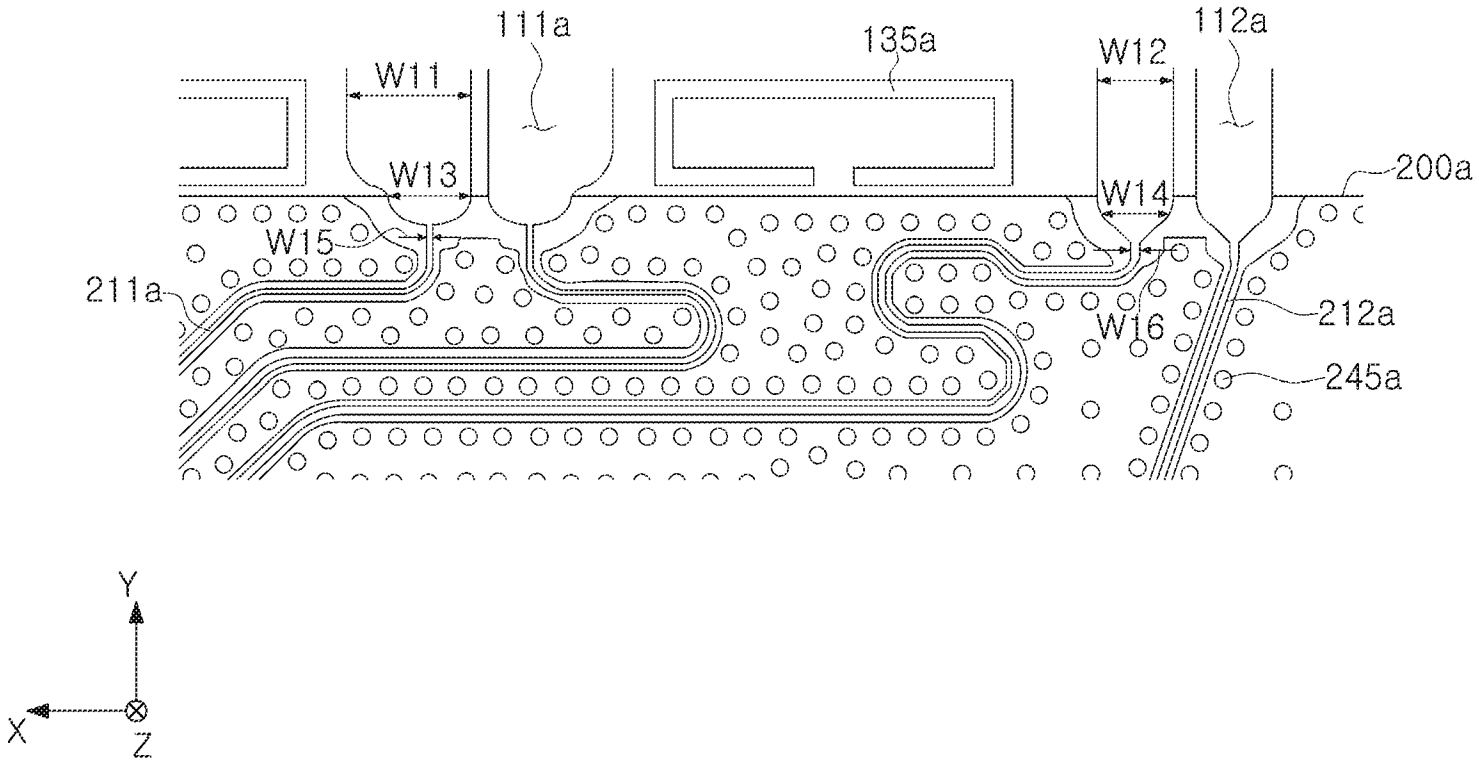
FIG. 3 is a bottom view illustrating an example of portions of the first and second feed lines of the antenna apparatus of FIGS. 1A to 1C.

FIG. 3 is a bottom view illustrating an example of portions of the first and second feed lines of the antenna apparatus of FIGS. 1A to 1C.

Referring to FIG. 3, a ground plane of the connection member 200*a* includes recesses accommodating end portions of the first and second feed lines 111*a* and 112*a*, and channels accommodating first wirings 211*a* electrically connected to the end portions of the first feed lines 111*a*, and second wirings 212*a* electrically connected to the end portions of the second feed lines 112*a*. A plurality of shielding vias 245*a* surround the end portions of the first and second feed lines 111*a* and 112*a* and the first and second wirings 211*a* and 212*a*.

The first feed lines 111*a* and the first wirings 211*a* have an impedance transformation pattern having a first width W11, a fifth width W15 that is narrower than the first width W11, and a third width W13 that is narrower than the first width W11 and wider than the fifth width W15.

The second feed lines 112*a* and the second wirings 212*a* have an impedance transformation pattern having a second width W12, a sixth width W16 that is wider than the second width W12, and a fourth width W14 that is narrower than the second width W12 and wider than the sixth width W16.

The impedance transformation patterns provide an additional was to perform transmission line impedance.

The first width W11 of the first feed lines 111*a* and 211*a* and the second width W12 of the second feed lines 112*a* and 212*a* are intrinsic parameters that respectively play a part in determining the respective intrinsic resonant frequencies of the first and second end-fire antenna patterns 121 and 122 in FIGS. 1A to 1C regardless of impedance matching conditions. Thus, a bandwidth of each of the first and second end-fire antenna patterns 121 and 122 is expanded more easily.

FIGS. 5A to 5D are bottom views illustrating an example of a plurality of ground planes of a connection member of an antenna apparatus sequentially arranged in the −Z direction.

Figure 5A:
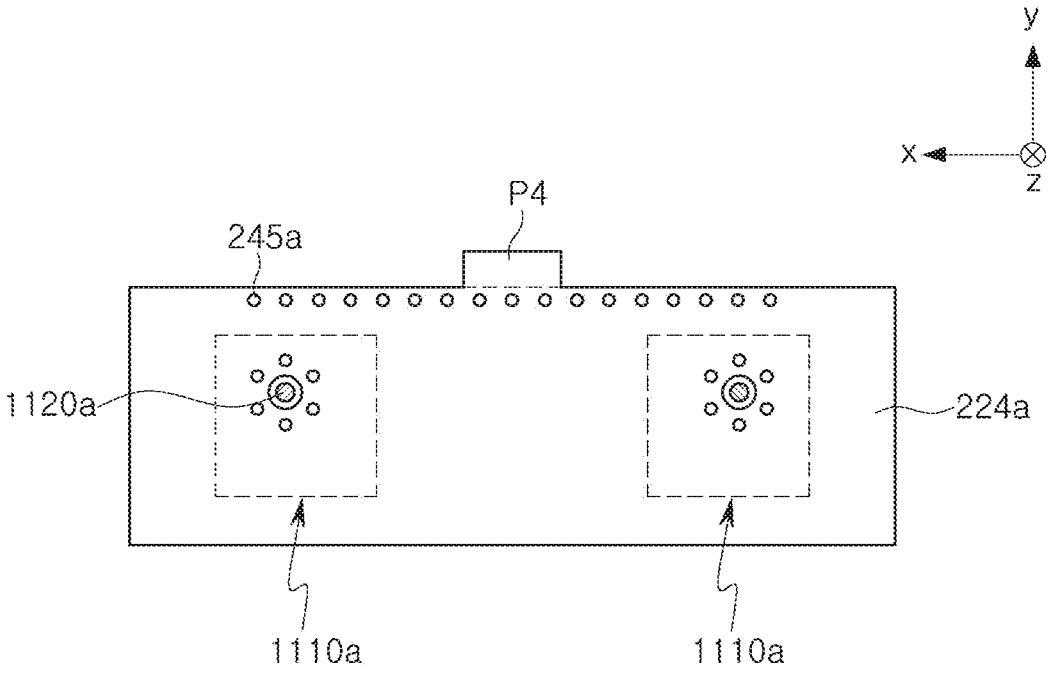
FIGS. 5A to 5D are bottom views illustrating an example of a plurality of ground planes of a connection member of an antenna apparatus sequentially arranged in the −Z direction.

Referring to FIG. 5A, a first ground plane 224*a* is disposed below a plurality of patch antenna patterns 1110*a*, and includes a plurality of through-holes through which a plurality of third feed vias 1120*a* respectively pass, and includes a first protruding region P4.

The plurality of patch antenna patterns 1110*a* transmit RF signals in the Z direction and receive RF signals in the −Z direction. Accordingly, the antenna apparatus performs RF signal transmission and reception in a vertical direction through the plurality of patch antenna patterns 1110*a*, and RF signal transmission and reception in a horizontal direction through a second end-fire antenna pattern 120*a* shown in FIG. 5D, thereby transmitting and receiving the RF signals in all directions.

Figure 5B:
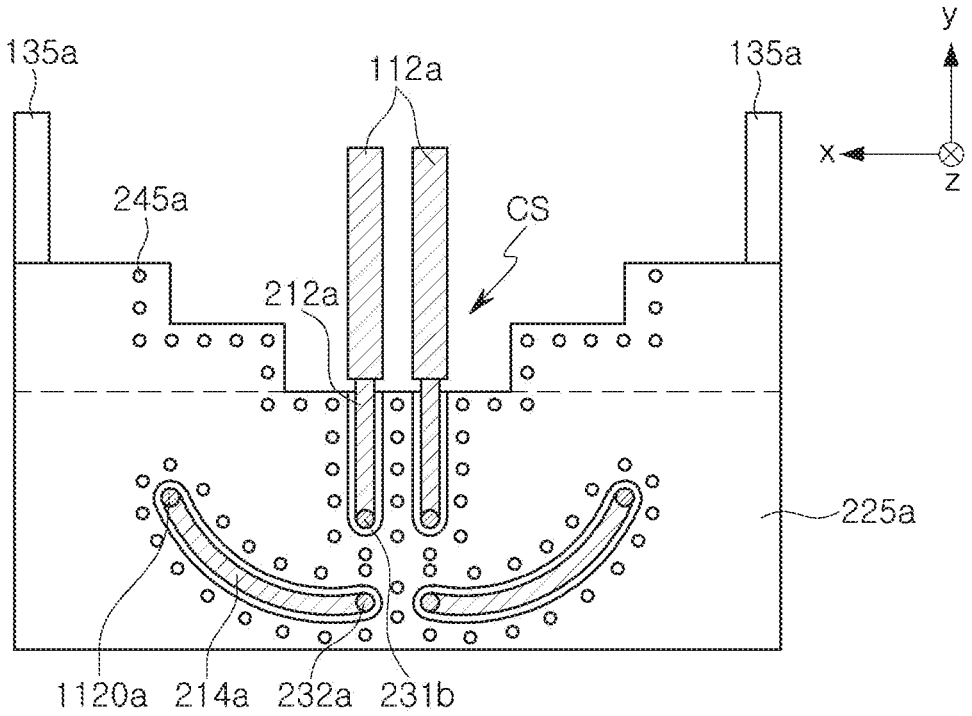

Referring to FIG. 5B, a second ground plane 225*a* surrounds second wirings 212*a* electrically connecting the second feed lines 112*a* to the second wiring vias 231*b*, and third wirings 214*a* electrically connecting the third feed vias 1120*a* to the third wiring vias 232*a*, and is connected to a fifth blocking pattern 135*a*.

Figure 5C:
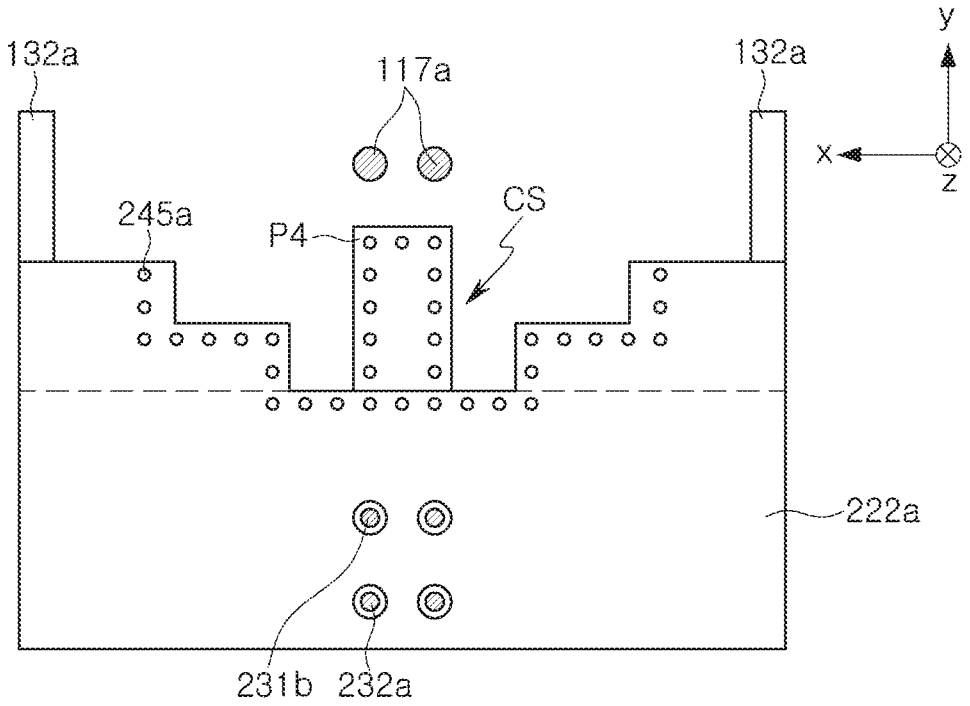

The plurality of shielding vias 245*a* are arranged along an edge of a stepped cavity CS, surround the second and third wirings 212*a* and 214*a*, and electrically connect the second ground plane 225*a* to a third ground plane 222*a* shown in FIG. 5C.

Referring to FIG. 5C, the third ground plane 222*a* includes through-holes through which the second and third wiring vias 231*b* and 232*a* respectively pass, and is connected to a second blocking pattern 132*a*. The plurality of shielding vias 245*a* are arranged along the edge of the stepped cavity CS and electrically connect the third ground plane 222*a* to a fourth ground plane 221*a* shown in FIG. 5D.

The second feed via 117*a* electrically connects the second end-fire antenna pattern to the second feed line.

Figure 5D:
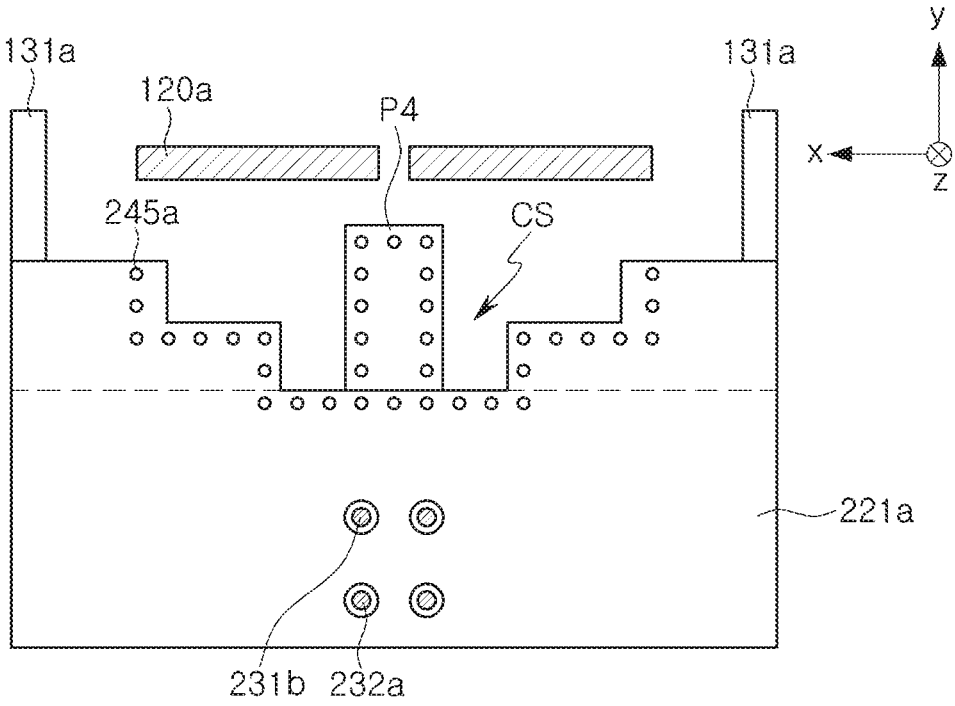

Referring to FIG. 5D, the fourth ground plane 221*a* includes through-holes through which the second and third wiring vias 231*b* and 232*a* respectively pass, and is connected to a first blocking pattern 131*a*. The plurality of shielding vias 245*a* are arranged along the edge of the stepped cavity CS. The second end-fire antenna pattern 120*a* is spaced away from the stepped cavity CS, for example, in the Y direction.

Figure 6A:
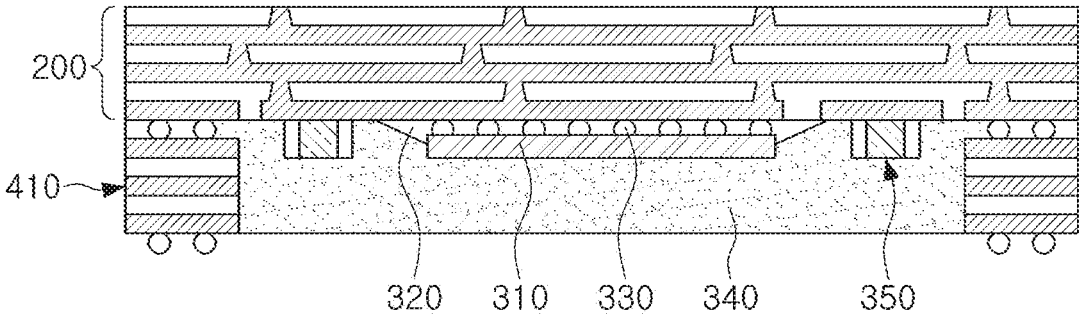
FIGS. 6A and 6B are side views illustrating examples of a connection member included in an antenna apparatus and a structure on a bottom surface of the connection member.
Figure 6B:
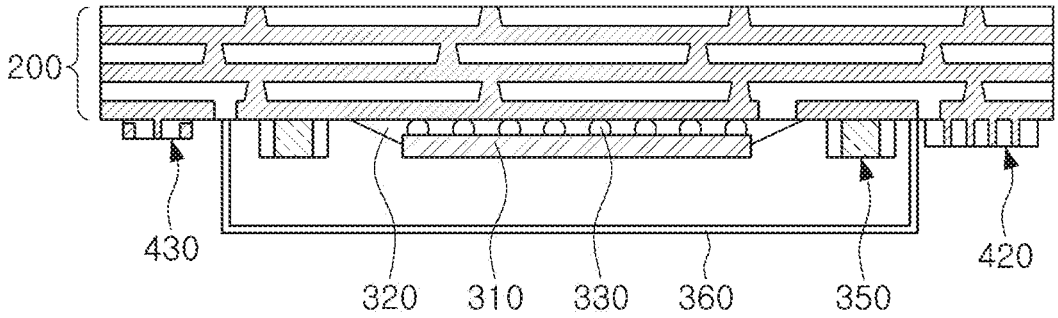

FIGS. 6A and 6B are side views illustrating examples of a connection member included in an antenna apparatus and a structure on a bottom surface of the connection member.

Referring to FIG. 6A, an antenna apparatus includes at least a portion of a connection member 200, an IC 310, an adhesive member 320, an electrical connection structure 330, an encapsulant 340, passive components 350, and a sub-substrate 410.

The connection member 200 has a structure similar to the connection member 200*a* described above with reference to FIGS. 1 to 5D, and has a structure in which a plurality of metal layers having patterns and a plurality of insulating layers are laminated, like in a printed circuit board (PCB).

The IC 310 corresponds to the unillustrated IC described above with respect to FIGS. 1A to 2B and 4, and is mounted on a bottom surface of the connection member 200. The IC 310 is electrically connected to wiring vias of the connection member 200 to transmit and receive RF signals, and is electrically connected to a ground plane of the connection member 200 to receive a ground. For example, the IC 310 may perform at least some of frequency conversion, amplification, filtering, phase control, and power generation to generate an RF signal from an intermediate frequency (IF) signal or a baseband signal, and generate an IF signal or a baseband signal from an RF signal.

The adhesive member 320 bonds the IC 310 and the connection member 200 to each other.

The electrical connection structure 330 electrically connects the IC 310 and the connection member 200 to each other. For example, the electrical connection structure 330 may have a structure such as solder balls, pins, lands, and pads. The electrical connection structure 330 has a melting point lower than wirings, vias, and ground planes of the connection member 200, thereby enabling the IC 310 and the connection member 200 to be electrically connected to each other using a predetermined joining process making use of the lower melting point of the electrical connection member 330.

The encapsulant 340 encapsulates the IC 310, and improves the heat radiation performance and the shock protection performance of the IC 310. For example, the encapsulant 340 may be a photoimageable encapsulant (PIE), an Ajinomoto Build-up Film (ABF), or an epoxy molding compound (EMC).

The passive components 350 are mounted on the bottom surface of the connection member 200, and are electrically connected to either one or both of the wirings and one of the ground planes of the connection member 200 through an electrical connection structure (not shown).

The sub-substrate 410 is mounted on the bottom surface of the connection member 200, and is electrically connected to the connection member 200 to receive an IF signal or a baseband signal from an external component and transmit the IF signal or the baseband signal to the IC 310, and receive an IF signal or a baseband signal from the IC 310 and transmit the signal to the external component. A frequency, for example, 24 GHz, 28 GHz, 36 GHz, 39 GHz, or 60 GHz, of the RF signal is greater than a frequency, for example, 2 GHz, 5 GHz, or 10 GHz, of the IF signal.

For example, the sub-substrate 410 may transmit an IF signal or an baseband signal to the IC 310, or may receive an RF signal or a baseband signal from the IC 310 through the wirings of the connection member 200. At least one of the ground planes of the connection member 200 is disposed between one or more patch antenna patterns (not shown) disposed above the connection member 200 and the wirings of the connection member 200, thereby electrically isolating the IF signal or the baseband signal from the RF signals transmitted and received by the one or more patch antenna patterns.

Referring to FIG. 6B, an antenna apparatus is similar to the antenna apparatus of FIG. 6A, but omits the sub-substrate member 410 of FIG. 6A, and further includes a shielding member 360, a connector 420, and a chip antenna 430.

The shielding member 360 is mounted on the bottom surface of the connection member 200 to shield the IC 310 together with the passive components 350 and a portion of the connection member 200. For example, the shielding member 360 may be disposed to conformally shield the IC 310 and the passive components 350 as shown in FIG. 6B, or compartmentally shield the IC 310 and the passive components 350 individually. For example, the shielding member 360 may have a hexahedral shape with one surface is side, and may form a hexahedral receiving space through bonding with the connection member 200. The shielding member 360 may be made of a material having a high conductivity such as copper so that the shielding member 360 has a shallow skin depth, and is electrically connected to one of the ground planes of the connection member 200. Accordingly, the shielding member 360 reduces electromagnetic noise applied to the IC 310 and the passive components 350.

The connector 420 is a connector for a cable (for example, a coaxial cable or a flexible PCB), is electrically connected to one of the IC ground planes of the connection member 200, and performs a function similar to a function of the sub-substrate 410 of FIG. 6A. For example, the connector 420 may receive an IF or a baseband signal power from a cable, and may output an IF signal or a baseband signal and power to the cable.

The chip antenna 430 transmits and receives an RF signal to assist the antenna apparatus. For example, the chip antenna 430 includes a dielectric block having a dielectric constant greater than a dielectric constant of insulating layers of the connection member 200, and two electrodes disposed on opposite surfaces of the dielectric block. One of the two electrodes is electrically connected to one of the wirings of the connection member 200, and the other one of the two electrodes is electrically connected to one of the ground planes of the connection member 200.

Figure 7A:
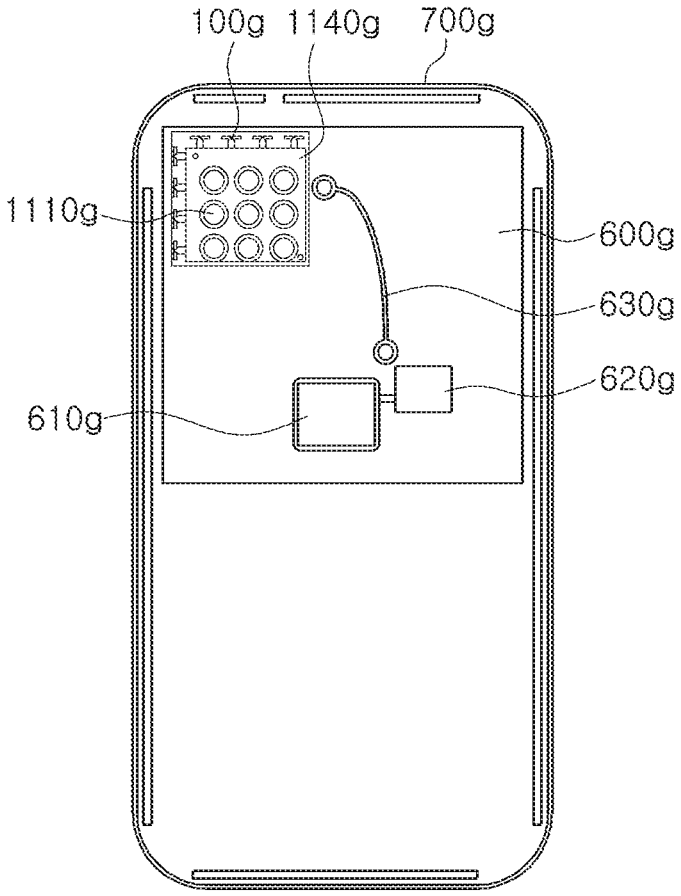
FIGS. 7A and 7B are plan views illustrating examples of an arrangement of an antenna apparatus in an electronic device.
Figure 7B:
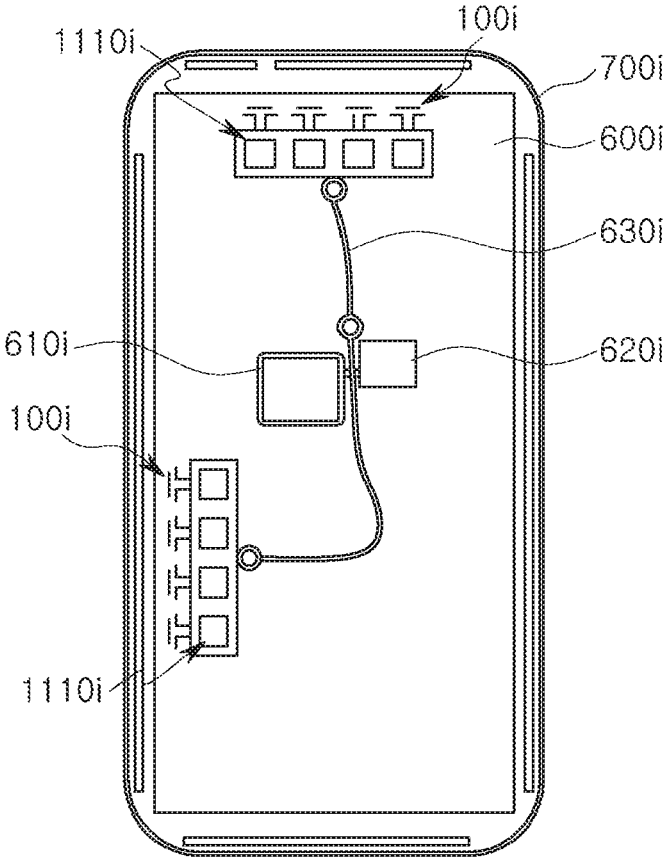

FIGS. 7A and 7B are plan views illustrating examples of an arrangement of an antenna apparatus in an electronic device.

Referring to FIG. 7A, an antenna module including antenna apparatuses 100*g*, patch antenna patterns 1110*g*, and a dielectric layer 1140*g* is disposed on a substrate 600*g* of an electronic device 700*g* in an inner corner of a rectangular case of the electronic device 700*g*.

The electronic device 700*g* may be a smartphone, a personal digital assistant, a digital video camera, a digital still camera, a network system, a computer, a monitor, a tablet PC, a laptop computer, a netbook, a television set, a video game, a smartwatch, or an automobile, but is not limited thereto.

A communications module 610*g* and a baseband circuit 620*g* are also disposed on the substrate 600*g*. The antenna module is electrically connected to either one or both of the communications module 610*g* and the baseband circuit 620*g* by a coaxial cable 630*g*.

The communications module 610*g* includes at least some of a memory chip such as a volatile memory (for example, a dynamic random-access memory (DRAM)) or a non-volatile memory (for example, a read-only memory (ROM) or a flash memory); an application processor chip such as a central processor (for example, a central processing unit (CPU)), a graphics processor (for example, a graphics processing unit (GPU)), a digital signal processor, a cryptographic processor, a microprocessor, or a microcontroller); and a logic chip such as an analog-digital converter or an application-specific IC (ASIC), to perform digital signal processing.

The baseband circuit 620*g* generates an IF signal or a baseband signal by performing analog-digital conversion, amplification, filtering, and frequency conversion on an analog signal, and the IF signal or the baseband signal is transmitted from the baseband circuit 620*g* to the antenna apparatus through the coaxial cable 630*g*. Also, the baseband circuit 620*g* generates an analog signal by performing frequency conversion, filtering, amplification, and digital-analog conversion on an IF signal or a baseband signal transmitted from the antenna apparatus to the baseband circuit 620*g* through the coaxial cable 630*g*.

For example, the IF signal or the baseband signal may be transmitted to or received from an IC (not shown) of the antenna apparatus corresponding to the unillustrated IC described in connection with FIGS. 1A to 2B and 4 through an electrical connection structure, wiring vias, wirings, feed lines, and feed vias. The IC converts the IF signal or the baseband signal into an RF signal in a millimeter wave (mmWave) band to be transmitted, and converts a received RF signal in an mmWave band into an IF signal or a baseband signal.

Referring to FIG. 7B, two antenna modules each including antenna apparatuses 100*i* and patch antenna patterns 1110*i* are disposed in diagonally opposite inner corners of a rectangular case of an electronic device 700*i* on a substrate 600*i* of the electronic device 700*i*, and a communications module 610*i* and a baseband circuit 620*i* are further disposed on the substrate 600*i*. The antenna modules are electrically connected to either one or both of the communications module 610*i* and the baseband circuit 620*i* by coaxial cables 630*i*.

The end-fire antenna patterns, the feed vias, the feed lines, the ground planes, the blocking patterns, the patch antenna patterns, the upper coupling patterns, the coupling structures, the peripheral vias, the dipole patterns, the coupling structure patterns, the shielding vias, the wiring vias, the wirings, the protruding regions, the electrical connection structures, and the electrodes of the chip antennas disclosed herein may include a metal material, for example, a conductive material, such as copper (Cu), aluminum (Al), silver (Ag), tin (Sn), gold (Au), nickel (Ni), lead (Pb), titanium (Ti), or an alloy of any two or more thereof, and may be formed by a plating method, such as chemical vapor deposition (CVD), physical vapor deposition (PVD), sputtering, a subtractive process, an additive process, a semi-additive process (SAP), or a modified semi-additive process (mSAP). However, the plating method is not limited thereto.

The insulating layers, the dielectric layers, the core layer, and the dielectric block described herein may be made of a liquid crystal polymer (LCP), a low temperature co-fired ceramic (LTCC), a thermosetting resin such as an epoxy resin, a thermoplastic resin such as a polyimide resin, a resin such as a thermosetting resin or a thermoplastic resin impregnated together with an organic filler into a core material such as glass fiber, glass cloth, or glass fabric, prepregs, Ajinomoto Build-Up Film (ABF), FR-4, a bismaleimide triazine (BT) resin, a photoimageable dielectric (PID) resin, a copper-clad laminate (CCL), or a glass- or ceramic-based insulating material. The dielectric layer and/or the insulating layer may fill at least a portion of the antenna apparatus according to an example, in which the end-fire antenna pattern, the feed line, the feed via, the ground plane, the blocking pattern, the patch antenna, the shielding via and the electrical connection structure are not disposed.

The RF signals referred to herein may have a format according to Wi-Fi (IEEE 802.11 family), Worldwide Interoperability for Microwave Access (WiMAX) (IEEE 802.16 family), IEEE 802.20, Long Term Evolution (LTE), Evolution-Data Optimized (EV-DO), Evolved High Speed Packet Access (HSPA+), High Speed Downlink Packet Access (HSDPA), High Speed Uplink Packet Access (HSUPA), Enhanced Data Rates for GSM Evolution (EDGE), Global System for Mobile Communications (GSM), Global Positioning System (GPS), General Packet Radio Service (GPRS), Code-Division Multiple Access (CDMA), Time-Division Multiple Access (TDMA), Digital Enhanced Cordless Telecommunications (DECT), Bluetooth, 3G, 4G, 5G, and any other wireless and wired protocols, but are not limited thereto.

The examples of an antenna apparatus described herein have a structure enabling the size thereof to be easily miniaturized, provide transmission and reception units in a plurality of different frequency bands, and improve antenna performance such as a gain, a bandwidth, a directivity, a transmission rate, and a reception rate.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus comprising:

a first feed line and a second feed line spaced apart from each other;

a ground plane surrounding a portion of each of the first and second feed lines;

a first end-fire antenna pattern and a second end-fire antenna pattern having different sizes spaced apart from each other, spaced apart from the ground plane, and respectively electrically connected to the first and second feed lines, and a first feed via and a second feed via respectively electrically connecting the first and second feed lines to the first and second end-fire antenna patterns, wherein the first feed via extends away from the first feed line in one direction, and the second feed via extends away from the second feed line in another direction different from the one direction.

2. The antenna apparatus of claim 1, wherein the first end-fire antenna pattern comprises a plurality of first dipole patterns having different sizes and at least partially overlapping each other when viewed in a direction perpendicular to respective surfaces of the plurality of first dipole patterns.

3. The antenna apparatus of claim 2, wherein a center width of each first dipole pattern of the plurality of first dipole patterns is greater than a width of one end of the first dipole pattern and is greater than a width of another end of the first dipole pattern.

4. The antenna apparatus of claim 1, wherein the second end-fire antenna pattern comprises a plurality of second dipole patterns overlapping each other when viewed in a direction perpendicular to respective surfaces of the plurality of second dipole patterns.

5. The antenna apparatus of claim 4, wherein a width of one end of each second dipole pattern of the plurality of second dipole patterns is smaller than a width of another end of the second dipole pattern, and the one end of the second dipole pattern having the smaller width is closer to the second feed via than the other end of the second dipole pattern.

6. The antenna apparatus of claim 1, wherein the first end-fire antenna pattern comprises a plurality of first dipole patterns at least partially overlapping each other when viewed in a direction perpendicular to surfaces of the plurality of first dipole patterns, and the second end-fire antenna pattern comprises a plurality of second dipole patterns at least partially overlapping each other when viewed in a direction perpendicular to surfaces of the plurality of second dipole patterns.

7. The antenna apparatus of claim 6, wherein each of the plurality of first dipole patterns is larger than each of the plurality of second dipole patterns, and a number of the plurality of first dipole patterns is greater than a number of the plurality of second dipole patterns.

8. The antenna apparatus of claim 6, wherein at least one of the plurality of first dipole patterns comprises a slit, and at least one of the plurality of second dipole patterns comprises a slit.

9. The antenna apparatus of claim 1, wherein a width of the first feed line is greater than a width of the second feed line.

10. The antenna apparatus of claim 9, wherein the first feed via is connected to a first end of the first feed line, the second feed via is connected to a first end of the second feed line, the antenna apparatus further comprises:

a first wiring electrically connected to a second end of the first feed line; and a second wiring electrically connected to a second end of the second feed line, the ground plane comprises:

a first recess accommodating the second end of the first line;

a second recess accommodating the second end of the second feed line;

a first channel accommodating the first wiring; and a second channel accommodating the second wiring, the first feed line and the first wiring comprise a first impedance transformation pattern comprising the second end of the first feed line accommodated in the first recess of the ground plane, and the second feed line and the second wiring comprise a second impedance transformation pattern comprising the second end of the second feed line accommodated in the second recess of the ground plane.

11. The antenna apparatus of claim 1, wherein a length of the first feed via is greater than a length of the second feed via.

12. The antenna apparatus of claim 11, wherein the first end-fire antenna is spaced apart from the ground plane in both a first direction and a second direction perpendicular to the first direction, the antenna apparatus further comprises a patch antenna pattern spaced apart from the ground plane in the second direction, and a distance between at least a portion of the first end-fire antenna pattern and the ground plane in the second direction is equal to or greater than a distance between the patch antenna pattern and the ground plane in the second direction.

13. The antenna apparatus of claim 1, wherein the first end-fire antenna pattern is spaced further away from the ground plane than the second end-fire antenna pattern.

14. The antenna apparatus of claim 1, further comprising a blocking pattern disposed between the first and second feed lines and spaced apart from the ground plane.

15. The antenna apparatus of claim 14, wherein the blocking pattern is a loop spaced apart from the ground plane, extending away from the ground plane, and having a gap in a side of the loop closest to the ground plane.

16. The antenna apparatus of claim 14, wherein the blocking pattern is disposed between a portion of each of the first and second end-fire antenna patterns and the ground plane.

17. An antenna apparatus comprising:

a ground plane extending in a first direction and a second direction perpendicular to the first direction;

a first end-fire antenna pattern spaced apart from an edge of the ground plane in the first direction;

a second end-fire antenna pattern spaced apart from the edge of the ground plane in the first direction and spaced apart from the first end-fire antenna pattern in the second direction;

a first feed via comprising a first end and a second end, the first end of the first feed via being electrically connected to the first end-fire antenna pattern;

a second feed via comprising a first end and a second end, the first end of the second feed via being electrically connected to the second end-fire antenna pattern;

a first feed line comprising a first end and a second end, the first end of the first feed line being electrically connected to the second end of the first feed via; and a second feed line comprising a first end and a second end, the first end of the second feed line being electrically connected to the second end of the second feed via, wherein the first feed via extends away from the first feed line in a third direction perpendicular to the first direction, the second feed via extends away from the second feed line in a direction opposite to the third direction, and the ground plane comprises:

a first recess in the edge of the ground plane, the first recess accommodating the second end of the first feed line; and a second recess in the edge of the ground plane, the second recess accommodating the second end of the second feed line.

18. The antenna apparatus of claim 17, further comprising:

a first wiring comprising a first end connected to the second end of the first feed line;

a second wiring comprising a first end connected to the second end of the second feed line, wherein the ground plane further comprises:

a first channel accommodating the first wiring; and a second channel accommodating the second wiring.

19. The antenna apparatus of claim 17, wherein the first end-fire antenna pattern comprises a plurality of first dipole patterns, the second end-fire antenna pattern comprises a plurality of second dipole patterns, the first end of the first feed via is connected to a first one of the first dipole patterns, and remaining ones of the first dipole patterns are sequentially spaced apart from the first one of the first dipole patterns in the third direction, and the first end of the second feed via is connected to a first one of the second dipole patterns, and remaining ones of the second dipole patterns are sequentially spaced apart from the first one of the second dipole patterns in the direction opposite to the third direction.

20. The antenna apparatus of claim 19, further comprising a patch antenna pattern spaced apart from the ground plane in the third direction, wherein a distance from the ground plane to a last one of the first dipole patterns farthest away from the ground plane is equal to or greater than a distance from the ground plane to the patch antenna pattern.

* * * * *